US008242873B2

(12) United States Patent
Hayasaki et al.

(10) Patent No.: US 8,242,873 B2
(45) Date of Patent: Aug. 14, 2012

(54) TRANSFORMER, SWITCHING POWER SUPPLY DEVICE, AND DC-DC CONVERTER DEVICE

(75) Inventors: Minoru Hayasaki, Mishima (JP); Keisuke Samejima, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/684,078

(22) Filed: Jan. 7, 2010

(65) Prior Publication Data

US 2010/0176907 A1 Jul. 15, 2010

(30) Foreign Application Priority Data

Jan. 15, 2009 (JP) ..... 2009-006897

(51) Int. Cl.
*H01F 27/28* (2006.01)
*H01F 17/06* (2006.01)
*H01F 27/30* (2006.01)

(52) U.S. Cl. ..... 336/220; 336/178; 336/182; 336/206

(58) Field of Classification Search ..... 336/220, 336/182, 178, 196, 198, 206
See application file for complete search history.

(56) References Cited

U.S. PATENT DOCUMENTS 4,549,158 A * 10/1985 Mitsui et al. ..... 336/83
4,791,395 A * 12/1988 Henderson, Sr. ..... 336/210

FOREIGN PATENT DOCUMENTS

JP 6-132146 A 5/1994
JP 7-192934 A 7/1995
JP 10-270261 A 10/1998
JP 2001-135529 A 5/2001
JP 2005-57016 A 3/2005

OTHER PUBLICATIONS

English translation of JP2005-057016.*
English translation of JP2001135529A.*
U.S. Appl. No. 12/628,037, filed Nov. 30, 2009. Applicants: Minoru Hayasaki, et al.
U.S. Appl. No. 12/719,749, filed Mar. 8, 2010. Applicant: Keisuke Samejima.

* cited by examiner

*Primary Examiner* — Anh Mai
*Assistant Examiner* — Ronald Hinson
(74) *Attorney, Agent, or Firm* — Fitzpatrick, Cella, Harper & Scinto

(57) ABSTRACT

The transformer includes: first and second cores each including a magnetic center leg and a magnetic outer leg positioned outside of the magnetic center leg; a first adhesion part that adheres the magnetic center leg of the first core and the magnetic center leg of the second core to each other; a second adhesion part that adheres the magnetic outer leg of the first core and the magnetic outer leg of the second core to each other; a bobbin inserted through the magnetic center leg of the first core and the magnetic center leg of the second core, a primary coil and a secondary coil being wound on the bobbin; and an elastic member that applies pressure to the magnetic outer leg of the first core and the magnetic outer leg of the second core in a neighborhood of the second adhesion part, in an inward direction of the transformer.

14 Claims, 9 Drawing Sheets

"PRIOR ART"

"PRIOR ART"

"PRIOR ART"

"PRIOR ART"

"PRIOR ART"

"PRIOR ART"

"PRIOR ART"

TRANSFORMER, SWITCHING POWER SUPPLY DEVICE, AND DC-DC CONVERTER DEVICE

BACKGROUND OF THE INVENTION

1. Field of the Invention

The present invention generally relates to a transformer, and more particularly relates to a transformer that is used in a switching power supply device or a DC-DC converter device.

2. Description of the Related Art

A transformer is a main electronic component used in a switching power supply device or a DC-DC converter device. The transformer is also called a voltage converter or an electric transformer. In the transformer, a magnetic field is created by a primary coil, and the magnetic field is transferred to a secondary coil coupled with the primary coil by a mutual inductance, thereby inducing a current in the secondary coil. This allows an input voltage to be stepped up or stepped down.

FIG. 6 is a perspective view illustrating a typical EE type transformer 100. A first ferrite core 101 and a second ferrite core 102 shaped like the letter E in horizontal section each have a magnetic center leg at the center. A coil bobbin 103 has a primary coil and a secondary coil wound thereon. A shaft of the coil bobbin 103 is hollow, and the magnetic center legs are inserted through this hollow shaft. Tape 107 is wound around an outer perimeter of the first ferrite core 101 and the second ferrite core 102 in a horizontal direction. The horizontal direction is a direction parallel to a horizontal plane that contains an X axis and a Y axis illustrated in FIG. 6.

FIG. 7 is a horizontal sectional view of the typical EE type transformer. A gap 115 is provided between a magnetic center leg 118*a* of the first ferrite core 101 and a magnetic center leg 118*b* of the second ferrite core 102. A primary coil 104 and a secondary coil 105 are wound on the coil bobbin 103 so as to sandwich an interlayer sheet 106.

A typical assembly procedure of the transformer 100 is described below. First, the primary coil 104, a first interlayer sheet 106, the secondary coil 105, and a second interlayer sheet 106 are wound on the coil bobbin 103 in sequence. Next, a terminal process is performed. The coil bobbin 103 is inserted through the first ferrite core 101, and also inserted through the second ferrite core 102 from the opposite side. Lastly, to fix the first ferrite core 101 and the second ferrite core 102, the tape 107 is wound around the outer perimeter of these cores in the horizontal direction. After this, varnish impregnation is carried out. An unsaturated polyester resin, a modified polyester resin, an alkyd resin, or the like is used as a varnish. The transformer 100 is dipped (immersed) into a bath containing such a varnish for a specified time period, with the terminal facing upward. To solidify the varnish, the transformer 100 is maintained at a high temperature for several hours. By performing such a varnish impregnation process, the varnish penetrates and solidifies between the cores, between the coil bobbin and the cores, and between the coils and the interlayer sheets, thereby integrating these parts. In the transformer 100 made in this manner, the cores are resistant to breaking even when a heat cycle is repeated. Since the cores are entirely surrounded by the varnish, growl noise of the transformer 100 can be reduced.

Note that the growl noise of the transformer 100 can be reduced by adhering, with an adhesive, the facing magnetic center leg 118*a* of the first ferrite core 101 and the facing magnetic center leg 118*b* of the second ferrite core 102 to each other, a facing first magnetic outer leg 116*a* of the first ferrite core 101 and a facing first magnetic outer leg 116*b* of the second ferrite core 102 to each other, and a facing second magnetic outer leg 117*a* of the first ferrite core 101 and a facing second magnetic outer leg 117*b* of the second ferrite core 102 to each other. In particular, Japanese Patent Application Laid-Open No. H10-270261 proposes that abutting surfaces of the cores are adhered to each other. Japanese Patent Application Laid-Open No. 2005-057016 proposes that varnish impregnation is performed after the abutting surfaces of the cores are adhered to each other. Japanese Patent Application Laid-Open No. 2001-135529 proposes that a spacer is sandwiched between the abutting surfaces of the cores and also an elastic sheet is sandwiched between an upper surface of the bobbin and an inner surface of an upper core facing the upper surface of the bobbin and between a lower surface of the bobbin and an inner surface of a lower core facing the lower surface of the bobbin.

However, the magnitude of growl noise generated varies among transformers that have undergone impregnation. FIG. 8 is a diagram illustrating an acoustic spectrum of growl noise in a transformer having small growl noise. FIG. 9 is a diagram illustrating an acoustic spectrum of growl noise in a transformer having large growl noise. A horizontal axis represents a frequency, and a vertical axis represents a growl noise magnitude. In the case where the impregnant has reached the magnetic center legs 118*a* and 118*b*, the facing magnetic center legs 118*a* and 118*b* are adhered firmly to each other. Growl noise is small in such a transformer. In a transformer in which the impregnant has not reached the magnetic center legs 118*a* and 118*b*, on the other hand, growl noise is large.

FIG. 10 is a view for explaining a growl noise generation mechanism in a transformer in which the first magnetic outer leg 116*a* of the first ferrite core 101 and the first magnetic outer leg 116*b* of the second ferrite core 102 are not adhered to each other and the second magnetic outer leg 117*a* of the first ferrite core 101 and the second magnetic outer leg 117*b* of the second ferrite core 102 are not adhered to each other. The first magnetic outer legs 116*a* and 116*b* rub against each other, so that large growl noise is generated. Likewise, the second magnetic outer legs 117*a* and 117*b* rub against each other, so that large growl noise is generated. Meanwhile, there is a gap between the magnetic center leg 118*a* of the first ferrite core 101 and the magnetic center leg 118*b* of the second ferrite core 102, and therefore no rubbing occurs therebetween.

Accordingly, by adhering the facing first magnetic outer legs 116*a* and 116*b* to each other and also adhering the facing second magnetic outer legs 117*a* and 117*b* to each other, the rubbing can be suppressed, and as a result the growl noise can be reduced. FIGS. 11 and 12 are views illustrating natural vibrations of the magnetic outer legs. When the facing two magnetic outer legs are adhered to each other, growl noise is reduced, and natural vibrations 119*a* of the first magnetic outer legs 116*a* and 116*b* and natural vibrations 119*b* of the second magnetic outer legs 117*a* and 117*b* remain.

As described above, the following features are necessary in order to reduce growl noise.

Feature (1): vibrations are suppressed by adhering the facing magnetic center legs to each other.

Feature (2): noise caused by the rubbing between the magnetic outer legs is suppressed by integrating the magnetic outer legs with each other by means of adhesion or the like.

Feature (3): the natural vibrations of the magnetic outer legs are suppressed.

Moreover, the following transformer quality needs to be achieved.

Feature (4): there is a low possibility of core breaking caused by a difference in heat expansion coefficient between the coil bobbin and the ferrite cores.

However, according to the adhesion technique described in Japanese Patent Application Laid-Open No. H10-270261, the features (3) and (4) remain to be solved. According to the adhesion and impregnation technique described in Japanese Patent Application Laid-Open No. 2005-057016, the feature (3) remains to be solved. According to the elastic sheet technique described in Japanese Patent Application Laid-Open No. 2001-135529, the features (1), (2), and (3) remain to be solved because vibrations between the cores cannot be suppressed.

Various electrical devices nowadays are desired to be energy-saving with low power consumption. For example, to make an IC and the like in a power supply device energy-saving, more and more devices reduce the number of times the power supply device is switched during light load operation for improving efficiency. This can lead to a situation where a driving frequency of a transformer included in the power supply device becomes an audible frequency. Besides, while the electronic device is in light-load operation, its operation sound is small. This makes the growl noise of the transformer even more noticeable. For these reasons, there is a need to reduce the growl noise of the transformer caused by the natural vibrations of the magnetic outer legs.

SUMMARY OF THE INVENTION

In view of the above-mentioned problems, an object of the present invention is to reduce growl noise of a transformer caused by natural vibrations of magnetic outer legs, while lessening the possibility of core breaking.

The present invention is a transformer including: a first core and a second core that each include a magnetic center leg and a magnetic outer leg positioned outside of the magnetic center leg; a first adhesion part that adheres the magnetic center leg of the first core and the magnetic center leg of the second core to each other; a second adhesion part that adheres the magnetic outer leg of the first core and the magnetic outer leg of the second core to each other; a bobbin that is inserted through the magnetic center leg of the first core and the magnetic center leg of the second core, a primary coil and a secondary coil being wound on the bobbin; and an elastic member that applies pressure to the magnetic outer leg of the first core and the magnetic outer leg of the second core in a neighborhood of the second adhesion part, in an inward direction of the transformer.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The following describes a structure and an operation according to the present invention. Specific embodiments are described after the description of the structure and the operation. Note that the embodiments provided below are merely examples and the technical scope of the present invention is not limited to such.

A first embodiment is described below.

Figure 1:
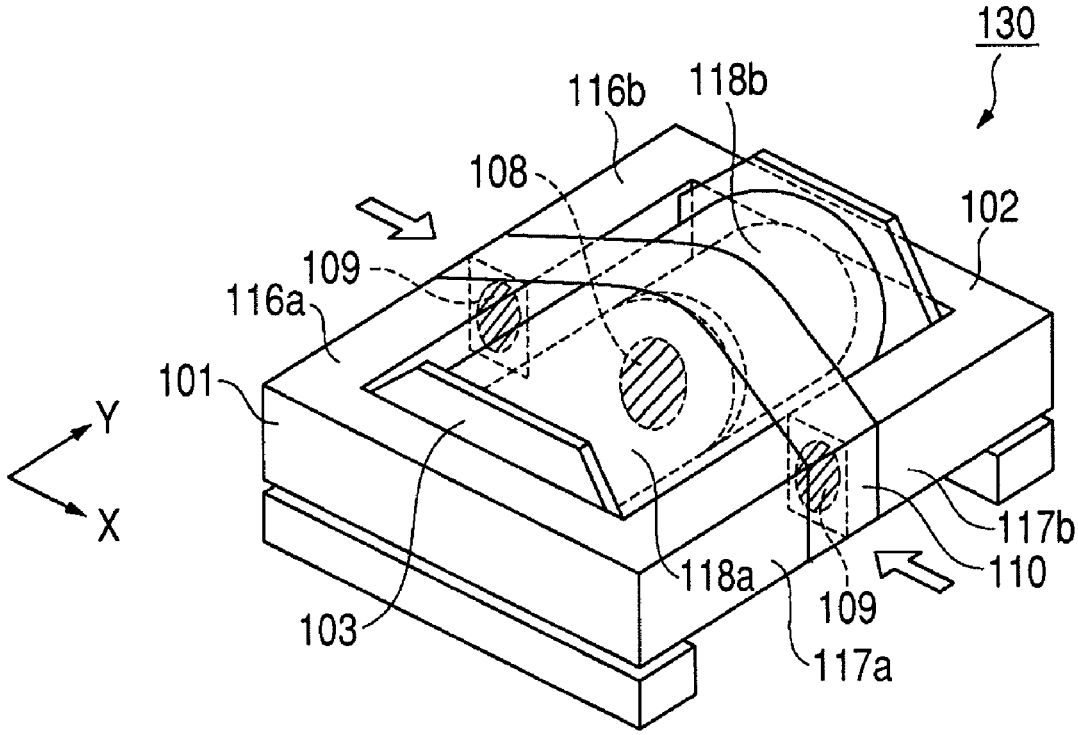
FIG. 1 is a perspective view illustrating an EE type transformer 130 according to a first embodiment.
Figure 1:
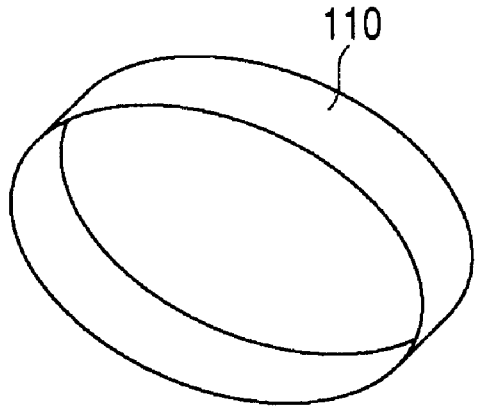

FIG. 1 is a perspective view illustrating an EE type transformer 130 according to the first embodiment. For example, the transformer 130 is used in a switching power supply device, a DC-DC converter device, and the like. A first ferrite core 101 shaped like the letter E in horizontal section includes a first magnetic outer leg 116*a*, a second magnetic outer leg 117*a*, and a magnetic center leg 118*a*. Likewise, a second ferrite core 102 includes a first magnetic outer leg 116*b*, a second magnetic outer leg 117*b*, and a magnetic center leg 118*b*. The first ferrite core 101 is an example of a first core, and the second ferrite core 102 is an example of a second core.

A coil bobbin 103 has a primary coil and a secondary coil wound thereon. A shaft of the coil bobbin 103 is hollow, and the magnetic center legs 118*a* and 118*b* are inserted through this hollow shaft. A horizontal direction is a direction parallel to a horizontal plane that contains an X axis and a Y axis illustrated in FIG. 1. The coil bobbin 103 is shaped like a cylinder having a hollow, as illustrated in FIG. 1. However, the coil bobbin 103 is not limited to the cylindrical shape, and a prismatic shape is also applicable.

In the first embodiment, in particular, an abutting surface of the magnetic center leg 118*a* and an abutting surface of the magnetic center leg 118*b* are adhered to each other with an adhesive 108. That is, the adhesive 108 forms a first adhesion part. As the adhesive 108, an adhesive with a high hardness after adhesion, e.g., about 70 in shore D hardness, such as a one-component or two-component epoxy adhesive can be used. An adhesive with a low hardness, e.g., about 40 in shore D hardness, does not have a sufficient effect on growl noise.

The first magnetic outer leg 116*a* of the first ferrite core 101 and the first magnetic outer leg 116*b* of the second ferrite core 102 are adhered to each other with an adhesive 109. Likewise, the second magnetic outer leg 117*a* and the second magnetic outer leg 117*b* are adhered to each other with the adhesive 109. That is, the adhesive 109 forms a second adhesion part. As the adhesive 109 for adhering abutting surfaces of the magnetic outer legs, an adhesive with a low viscosity before hardening can be used. When an adhesive with a high viscosity before hardening is used, a gap between the magnetic outer legs becomes, for example, 10 μm or more, causing an increase in leakage inductance. Moreover, when the gap is 10

μm or more, an inductance value (L value) of the transformer decreases. Accordingly, an adhesive with a low viscosity before hardening and a high hardness after hardening is used in this embodiment. Note that an adhesive with a high viscosity before hardening can be used depending on a selected transformer structure and specification.

A heat shrinkable tube 110 is an example of an elastic member that applies pressure to the magnetic outer leg of the first core and the magnetic outer leg of the second core in a neighborhood of the second adhesion part, in an inward direction of the transformer. As the heat shrinkable tube 110, a fire retardant tube can be used. For example, a heat shrinkable tube made from electron beam bridge polyolefin or silicon rubber can be adopted as the heat shrinkable tube 110.

As illustrated in FIG. 1, a winding position of the heat shrinkable tube 110 is such a position that covers the abutting surfaces of the first ferrite core 101 and second ferrite core 102. Moreover, the heat shrinkable tube 110 is wound in a direction orthogonal to an axial direction of the magnetic center legs.

The heat shrinkable tube 110 is an annular elastic member, and shrinks in inner perimeter (internal diameter) when heat is applied. The inner perimeter (internal diameter) of the heat shrinkable tube 110 before heat shrinkage needs to be larger than an outer perimeter (outer diameter) of the transformer in the direction orthogonal to the magnetic center legs, and the inner perimeter (internal diameter) of the heat shrinkable tube 110 after heat shrinkage needs to be smaller than the outer perimeter (outer diameter) of the transformer in the direction orthogonal to the magnetic center legs. This is intended to enable an interfacial pressure to remain between the abutting surfaces of the magnetic outer legs by a tensile stress induced by the heat shrinkable tube 110.

<Growl Noise Generation Mechanism in the Transformer>

When the transformer 130 is excited by feeding a current through the coils of the transformer 130, a magnetic field is generated by the coils. This magnetic field causes an electromagnetic force to be generated in each core in a direction that attracts the facing core to the core. Each core is elastically deformed, though slightly, due to the electromagnetic force. Furthermore, each core is also elastically deformed due to a magnetic strain of a core material caused by the magnetic field. The electromagnetic force and the magnetic strain are large in an area where a magnetic flux density is high. This being so, the magnetic center leg is subject to a largest force in the core. Hence, the amount of displacement of the core is largest at the magnetic center leg. When the generation of the magnetic field stops, a restoring force appears and the core tries to return to the original shape.

Vibrations generated in such a manner are transferred to the magnetic outer legs while elastically deforming each core itself. In the case where the magnetic outer legs are not adhered to each other, the magnetic outer legs rub against each other, as a result of which noise is generated. In the case where the magnetic outer legs are adhered to each other, the magnetic outer legs have a natural vibration frequency. The natural vibration frequency differs depending on a state of adhesion of the magnetic outer legs, and also vibrations at the natural vibration frequency cannot be suppressed merely by adhering the magnetic outer legs to each other.

Figure 2:
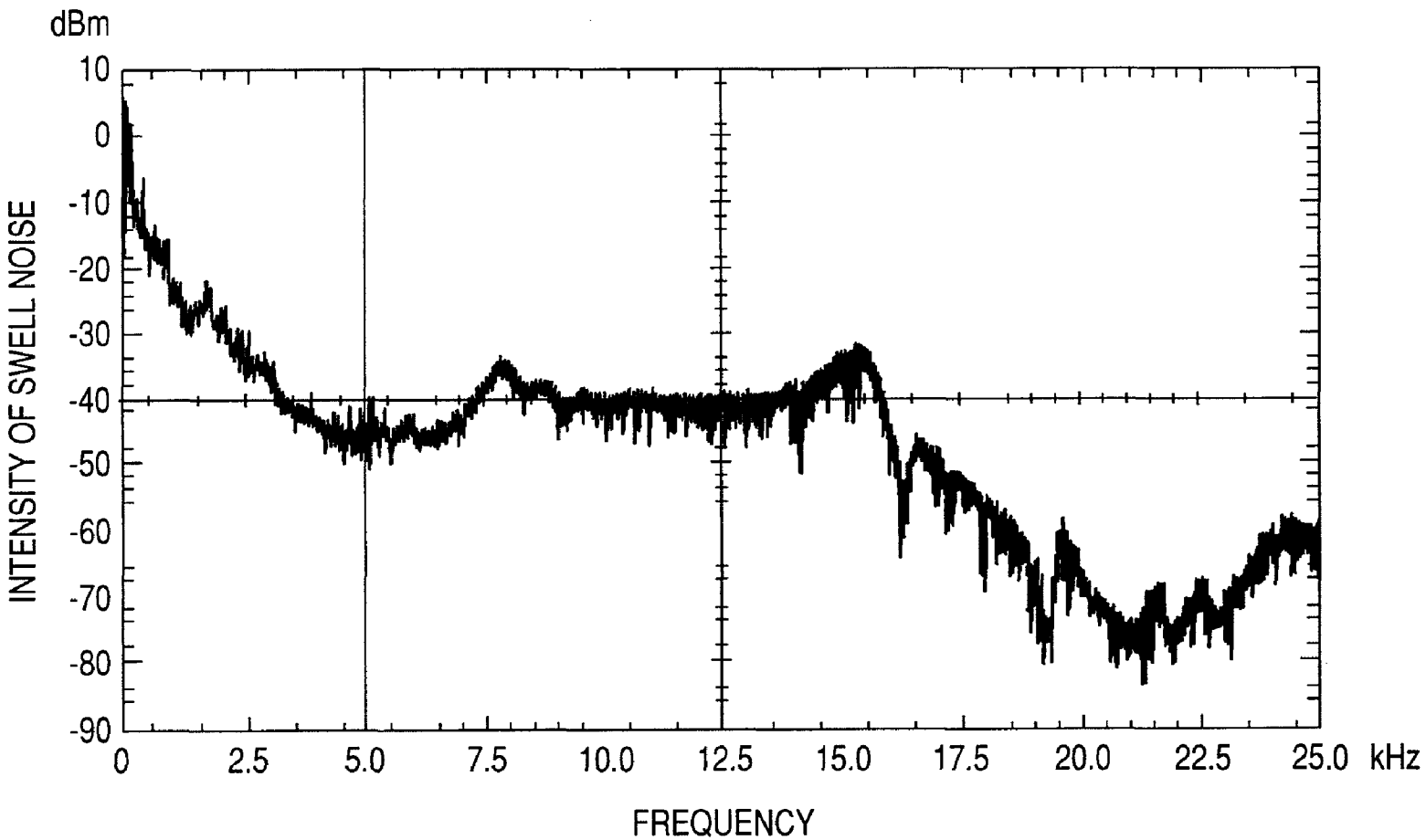
FIG. 2 is a diagram illustrating a frequency spectrum of growl noise generated in the transformer 130 according to the first embodiment.

In view of this, in this embodiment, the natural vibrations of the magnetic outer legs are suppressed by putting the heat shrinkable tube 110 over the transformer 130. A tensile stress induced by the heat shrinkable tube 110 enables an interfacial pressure to remain between the abutting surfaces of the magnetic outer legs. FIG. 2 is a diagram illustrating a frequency spectrum of growl noise generated in the transformer 130 according to the first embodiment. As illustrated in FIG. 2, the growl noise can be reduced to about 6 dBm according to the first embodiment.

Furthermore, by using the heat shrinkable tube 110, the coil bobbin 103, the first ferrite core 101, and the second ferrite core 102 are fixed by the elastic member. Therefore, even when the adhesive 108 at the magnetic center legs overflows and sticks to the coil bobbin 103, there is only one area where the coil bobbin and the cores are firmly adhered to each other, so that the possibility of core breaking is extremely low. This eliminates the need to strictly define the amount of the adhesive 108 at the magnetic center legs, and so contributes to improved workability.

Figure 3:
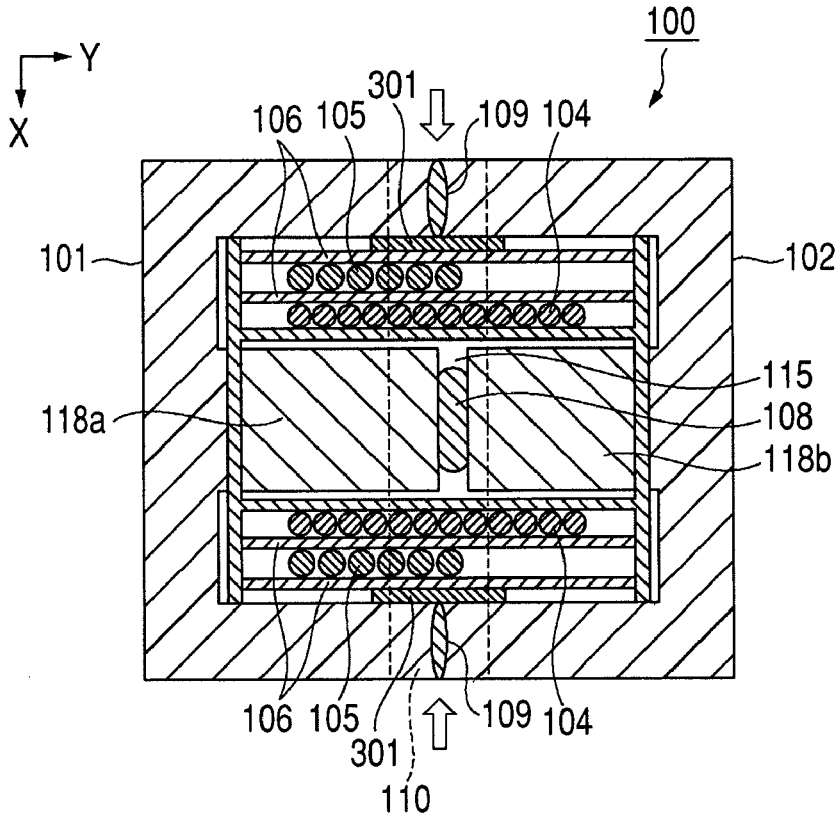
FIG. 3 is a horizontal sectional view of the EE type transformer according to the first embodiment.

FIG. 3 is a horizontal sectional view of the EE type transformer according to the first embodiment. A gap 115 is provided between the magnetic center leg 118*a* of the first ferrite core 101 and the magnetic center leg 118*b* of the second ferrite core 102. As mentioned earlier, the adhesive 108 is filled in the gap 115. A primary coil 104 and a secondary coil 105 are wound on the coil bobbin 103 so as to sandwich an interlayer sheet 106.

As illustrated in FIG. 3, an elastic member 301 is fit between a coil that is formed by the coil bobbin 103, the primary coil 104, and the secondary coil 105, and the magnetic outer legs. That is, the elastic member 301 is sandwiched between the coil and the adhesion part of the magnetic outer legs. The heat shrinkable tube 110 suppresses the natural vibrations of the magnetic outer legs in an outward direction of the transformer 130, and the elastic member 301 suppresses the natural vibrations of the magnetic outer legs in an inward direction of the transformer 130. The growl noise reduction effect can be further enhanced by the heat shrinkable tube 110 and the elastic member 301.

According to the first embodiment, the heat shrinkable tube 110 that applies pressure, in the inward direction of the transformer 130, to the magnetic outer legs of the first ferrite core 101 and the magnetic outer legs of the second ferrite core 102 in the neighborhood of the second adhesion part is adopted. This allows the natural vibrations of the magnetic outer legs to be suppressed, as a result of which the growl noise can be reduced.

In a switching power supply device or a DC-DC converter, the number of times of switching is reduced during light-load operation. The growl noise of the transformer caused by the natural vibrations of the magnetic outer legs tends to be noticeable when the switching power supply device or the DC-DC converter is in light-load operation. However, by adopting the transformer 130 according to this embodiment in the switching power supply device or the DC-DC converter device, the growl noise can be reduced, enabling the switching power supply device or the DC-DC converter device to operate at a lower frequency. Such a lower-frequency operation provides an improvement in power supply efficiency.

Though a flexible tube is applied in this embodiment, the same effect can be achieved even when, for example, flexible tape is used.

The following describes a second embodiment.

In the first embodiment, the heat shrinkable tube 110 is used as the elastic member that applies pressure to the magnetic outer legs of the first ferrite core 101 and the magnetic outer legs of the second ferrite core 102. In the second embodiment, a flexible tube is used as the elastic member. The heat shrinkable tube 110 shrinks when heated. On the other hand, the flexible tube does not need such a heating step, and therefore the manufacturing process can be simplified.

Figure 4:
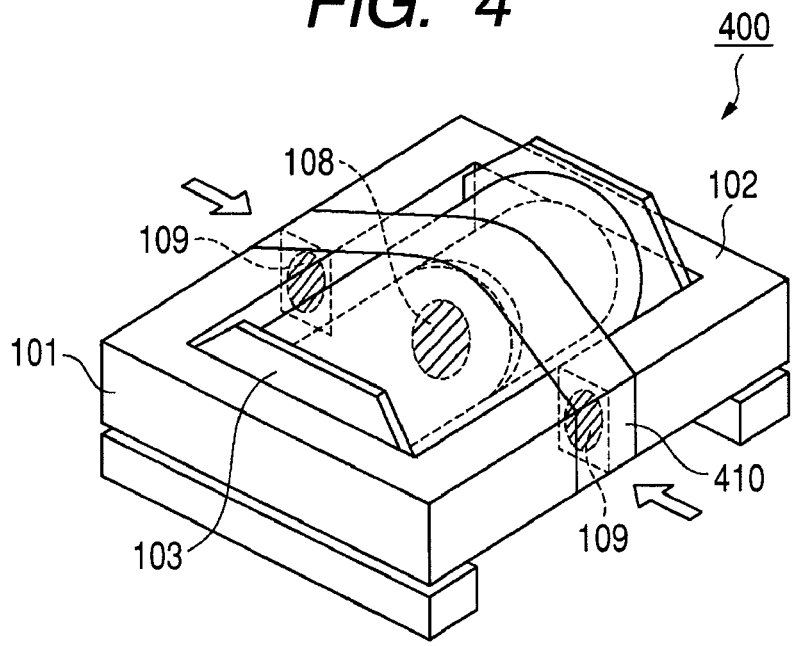
FIG. 4 is a perspective view illustrating an EE type transformer 400 according to a second embodiment.

FIG. 4 is a perspective view illustrating an EE type transformer 400 according to the second embodiment. A flexible tube 410 is adopted instead of the heat shrinkable tube 110. As the flexible tube 410, a tube made from a material having an excellent high temperature resistance, heat cycle resistance, tear resistance, and fire retardance, such as silicon rubber, can be used.

According to the second embodiment, the effect of simplifying the manufacturing process can be achieved in addition to the same effect as the first embodiment. Here, the elastic member 301 may be fit between the coil formed by the coil bobbin 103, the primary coil 104, and the secondary coil 105, and the magnetic outer legs, as in the first embodiment. The growl noise can be further reduced by the flexible tube 410 and the elastic member 301.

The following describes a third embodiment.

As the elastic member that applies pressure to the magnetic outer legs of the first ferrite core 101 and the magnetic outer legs of the second ferrite core 102, the heat shrinkable tube 110 is adopted in the first embodiment and the flexible tube 410 is adopted in the second embodiment. In the third embodiment, a springing member is adopted.

Figure 5:
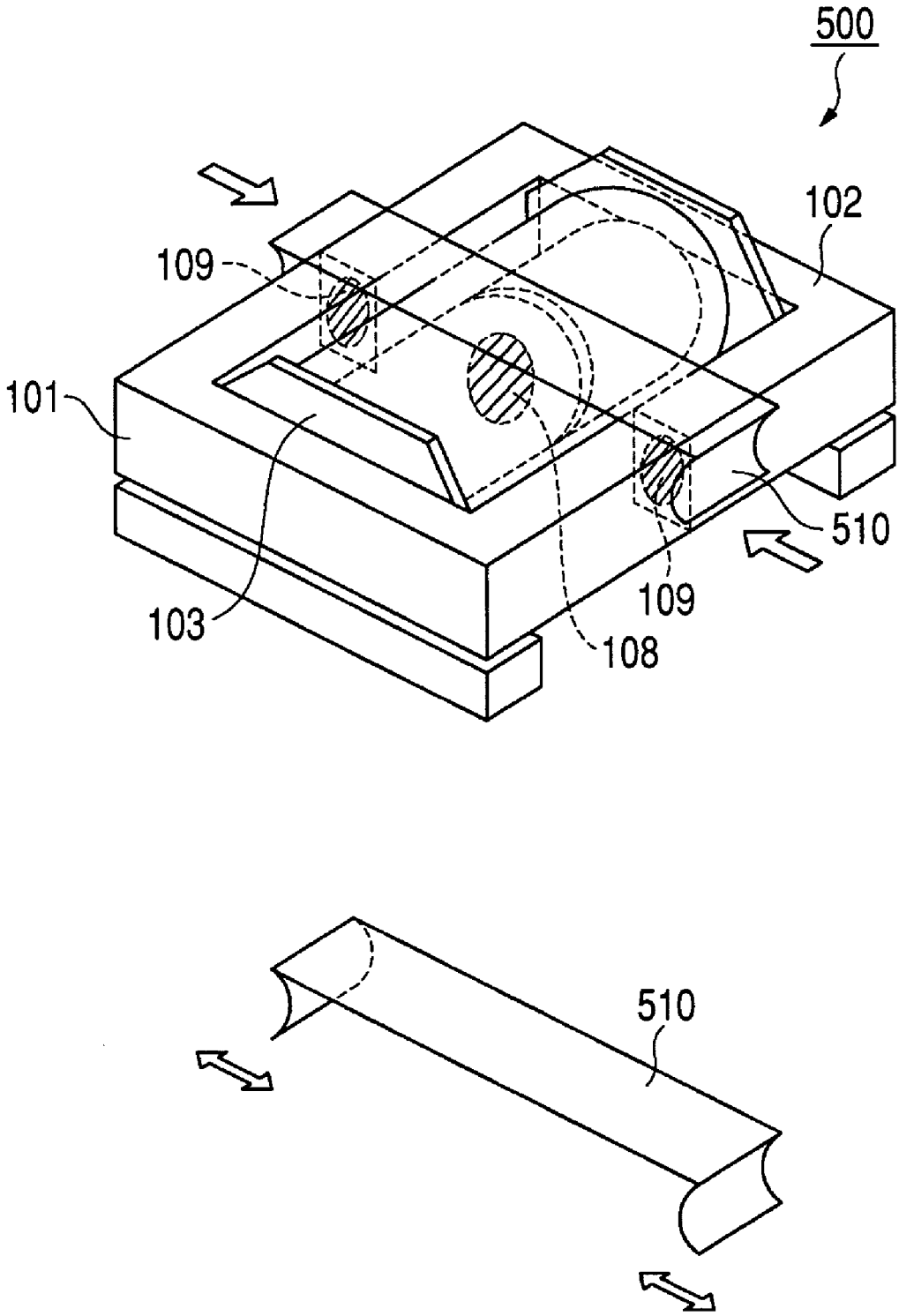
FIG. 5 is a perspective view illustrating an EE type transformer 500 according to a third embodiment.
Figure 6:
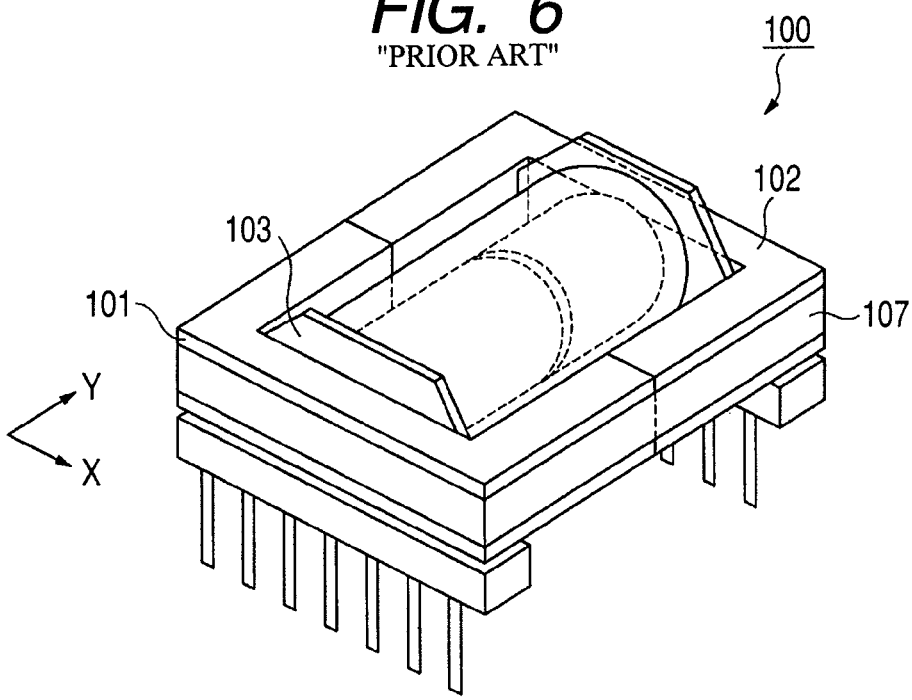
FIG. 6 is a perspective view illustrating a typical EE type transformer 100.
Figure 7:
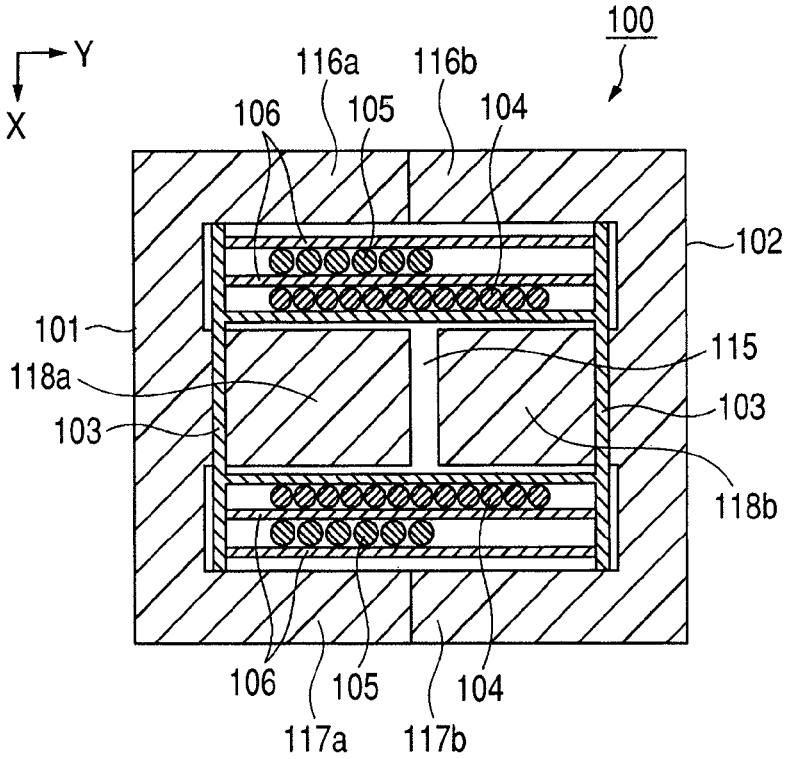
FIG. 7 is a horizontal sectional view of the typical EE type transformer.
Figure 8:
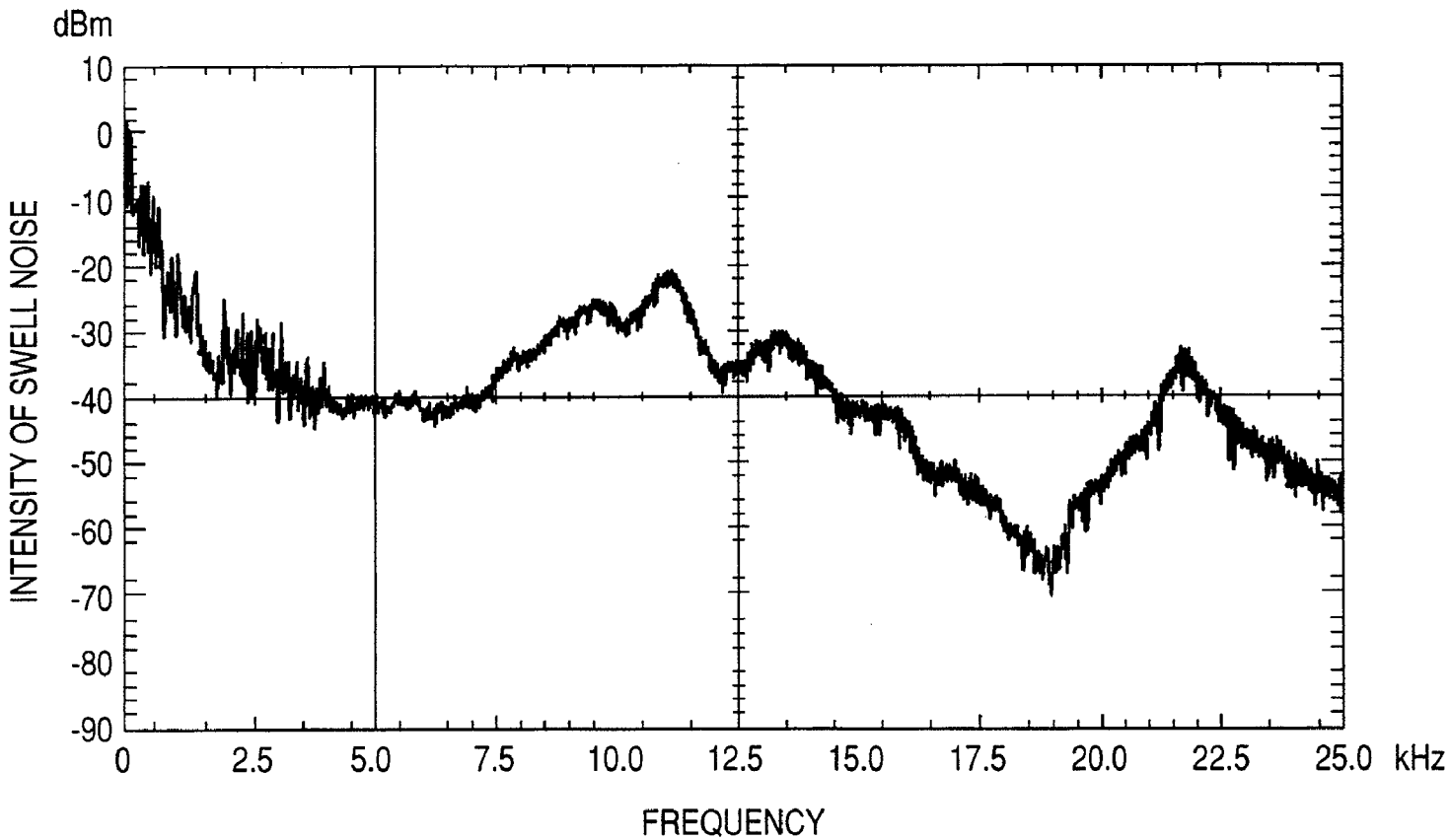
FIG. 8 is a diagram illustrating an acoustic spectrum of growl noise in a transformer having small growl noise.
Figure 9:
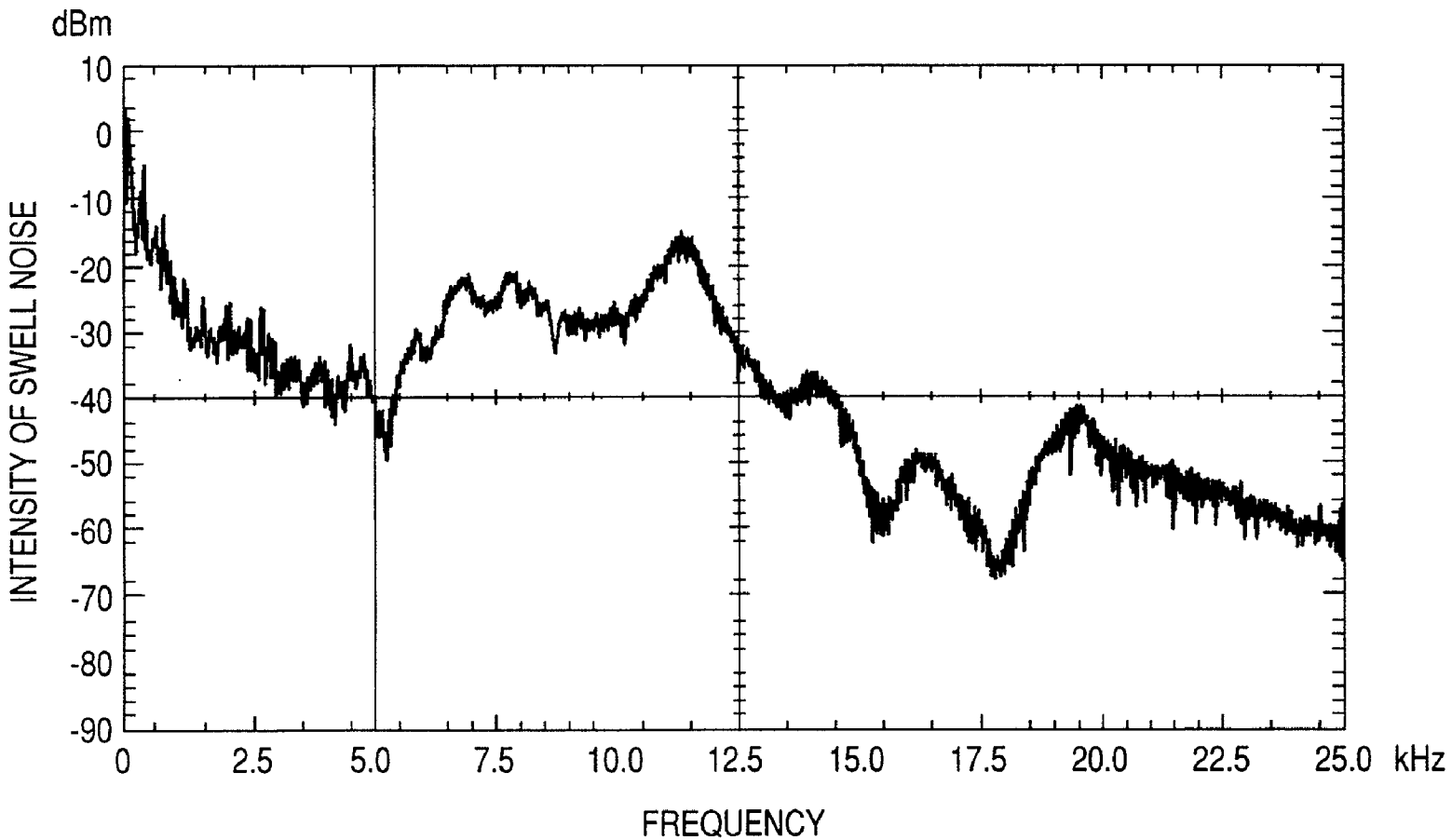
FIG. 9 is a diagram illustrating an acoustic spectrum of growl noise in a transformer having large growl noise.
Figure 10:
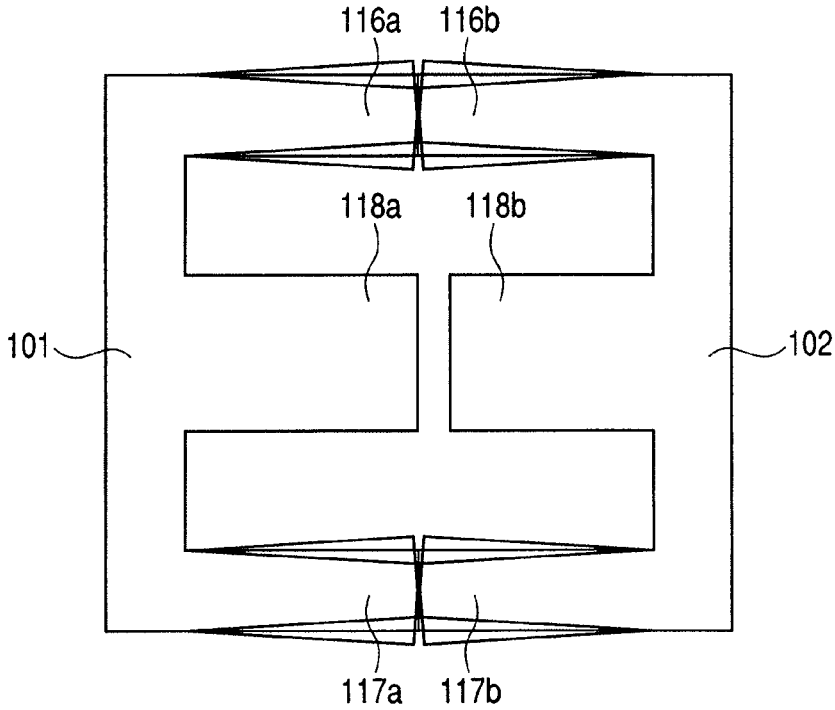
FIG. 10 is a view for explaining a growl noise generation mechanism in a transformer in which magnetic outer legs are not adhered to each other.
Figure 11:
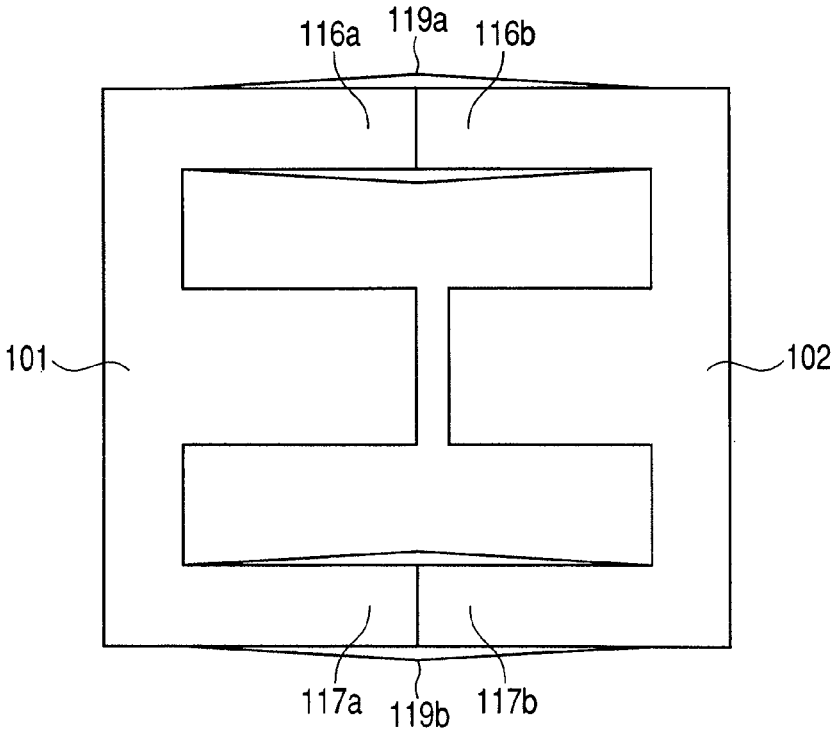
FIG. 11 is a view illustrating natural vibrations of magnetic outer legs.
Figure 12:
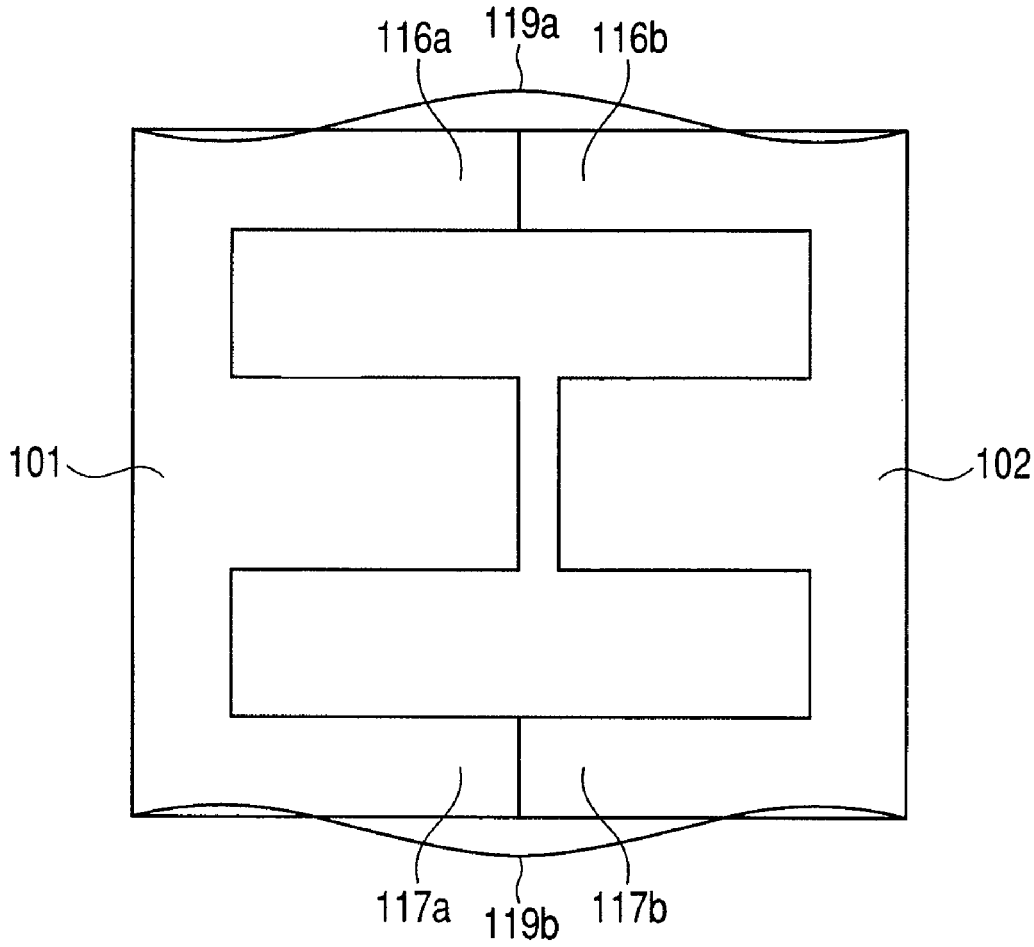
FIG. 12 is a view illustrating natural vibrations of magnetic outer legs.

FIG. 5 is a perspective view illustrating an EE type transformer 500 according to the third embodiment. In this embodiment, a springing member 510 is adopted instead of the heat shrinkable tube 110 or the flexible tube 410. The springing member 510 applies pressure to the magnetic outer legs of the first ferrite core 101 and the magnetic outer legs of the second ferrite core 102, in the direction from the magnetic outer legs toward the magnetic center legs. This enables an interfacial pressure to act upon the abutting surfaces of the magnetic outer legs.

According to the third embodiment, the same effect as the first embodiment can be achieved. Here, the elastic member 301 may be fit between the coil formed by the coil bobbin 103, the primary coil 104, and the secondary coil 105, and the magnetic outer legs, as in the first and second embodiments. The growl noise can be further reduced by the springing member 510 and the elastic member 301.

Though the above first to third embodiments describe a horizontal transformer as an example, a vertical transformer is equally applicable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-006897, filed on Jan. 15, 2009, which is hereby incorporated by reference herein in its entirety.

What is claimed is:

1. A transformer comprising:

a first core and a second core that each includes a magnetic center leg and a magnetic outer leg positioned outside of the magnetic center leg;

a first adhesion part that adheres the magnetic center leg of the first core and the magnetic center leg of the second core to each other;

a second adhesion part that adheres the magnetic outer leg of the first core and the magnetic outer leg of the second core to each other;

a bobbin on which a primary coil and a secondary coil are wound, the bobbin being inserted through the magnetic center leg of the first core and the magnetic center leg of the second core; and a heat shrinkable tube that contacts an area proximate to the second adhesion part to apply pressure to the magnetic outer leg of the first core and the magnetic outer leg of the second core in an inward direction of the transformer, wherein the heat shrinkable tube has an internal diameter before heat shrinkage that is larger than an outer diameter of the transformer in a direction orthogonal to the magnetic center legs, and has an internal diameter after heat shrinkage that is smaller than the outer diameter of the transformer.

2. A transformer according to claim 1, further comprising an elastic member that is provided in between the bobbin and the magnetic outer legs.

3. A switching power supply device comprising the transformer according to claim 1.

4. A switching power supply device comprising the transformer according to claim 2.

5. A DC-DC converter device comprising the transformer according to claim 1.

6. A DC-DC converter device comprising the transformer according to claim 2.

7. A transformer comprising:

a core having a magnetic center leg and magnetic outer legs, each of the magnetic outer legs including one or more joint parts at which the magnetic outer legs are jointed with each other;

a coil that is provided between the magnetic center leg and the magnetic outer legs; and a vibration suppress member for suppressing a vibration at the joint parts, wherein the vibration suppress member is provided between the coil and the magnetic outer legs, and the vibration suppress member contacts the one or more joint parts.

8. A transformer according to claim 7, further comprising another vibration suppress member, wherein the other vibration suppress member is a heat shrinkable tube that applies pressure to the joint parts, in an inward direction of the transformer.

9. A transformer according to claim 7, further comprising another vibration suppress member, wherein the other vibration suppress member is a flexible tube.

10. A transformer according to claim 7, further comprising another vibration suppress member, wherein the other vibration suppress member is a springing member.

11. A switching power supply device comprising:

a transformer comprising:

a core having a magnetic center leg and magnetic outer legs, each of the magnetic outer legs including one or more joint parts at which the magnetic outer legs are jointed with each other;

a coil that is provided between the magnetic center leg and the magnetic outer legs; and a vibration suppress member for suppressing a vibration at the joint parts, wherein the vibration suppress member is provided between the coil and the magnetic outer legs, and the vibration suppress member contacts the one or more joint parts, and wherein the vibration suppress member suppresses the vibration at the joint parts in a case where the switching power supply is operated under a low load.

12. A transformer according to claim 7, wherein the vibration suppress member includes a first vibration suppress member and a second vibration suppress member, and wherein the first vibration suppress member is configured to suppress a vibration at one of the joint parts and the second vibration suppress member is configured to suppress a vibration at another one of the joint parts.

13. A transformer according to claim 7, wherein the vibration suppress member is an elastic member.

14. A transformer according to claim 1, wherein the heat shrinkable tube is wound in a direction orthogonal to an axial direction of the magnetic center legs, so as to substantially prevent vibration of the outer magnetic legs.

* * * * *